United States Patent [19]

Kimura

[11] Patent Number: 4,717,274

[45] Date of Patent: Jan. 5, 1988

[54] PRINTER

[75] Inventor: Tetsuo Kimura, Sagamihara, Japan

[73] Assignee: Canon Kabushiki Kaisha, Tokyo, Japan

[21] Appl. No.: 47,547

[22] Filed: May 5, 1987

Related U.S. Application Data

[63] Continuation of Ser. No. 766,675, Aug. 16, 1985, abandoned, which is a continuation of Ser. No. 558,601, Dec. 6, 1983, abandoned.

[30] Foreign Application Priority Data

Dec. 9, 1982 [JP] Japan ..... 57-216330

[51] Int. Cl.[4] ..... B41J 11/30; B41J 13/036

[52] U.S. Cl. ..... 400/616.2; 400/636.1; 400/637.1

[58] Field of Search ..... 400/605, 616, 616.1, 400/616.2, 616.3, 636.1, 637, 637.1, 639, 639.1, 639.2

[56] References Cited

U.S. PATENT DOCUMENTS

| | | | |
|---|---|---|---|
| 848,316 | 3/1907 | McLaughlin | 400/637.1 |
| 1,270,979 | 7/1918 | Schwartz | 400/639.1 |
| 2,131,152 | 9/1938 | Stickney | 400/637.1 X |
| 3,880,016 | 4/1975 | Jamieson et al. | 400/616.1 X |
| 4,197,022 | 4/1980 | Dollenmayer | 400/144.2 |
| 4,421,428 | 12/1983 | Noda et al. | 400/120 |
| 4,486,108 | 12/1984 | Tanaka | 400/637.1 X |

FOREIGN PATENT DOCUMENTS

| | | | |
|---|---|---|---|
| 38175 | 3/1982 | Japan | 400/616.1 |
| 57-84883 | 3/1982 | Japan . | |

OTHER PUBLICATIONS

IBM Technical Disclosure Bulletin vol. 19 No. 5 Nov. 1976 pp. 1955–1956 "Feed Rollers, Aligner & Paper Bail Actuation" by Bullock et al.

IBM Technical Disclosure Bulletin vol. 23 No. 9 Feb. 1981 pp. 3961–3963 "Automatic First Writing Line Mechanism" by Sweat, Jr.

*Primary Examiner*—Charles Pearson

*Attorney, Agent, or Firm*—Fitzpatrick, Cella, Harper & Scinto

[57] ABSTRACT

There is disclosed a printer provided with a sheet advancing roller to be wound by a printing sheet and for advancing the printing sheet upon rotation, first and second movable pressure rollers which can be contacted with or separated from the sheet advancing roller, and a mechanism for contacting or separating the first and second movable pressure rollers with or from the sheet advancing roller, further provided with an operating knob for contacting either of the first and second movable pressure rollers with the sheet advancing roller.

4 Claims, 12 Drawing Figures

FIG. 7
FIG. 7A
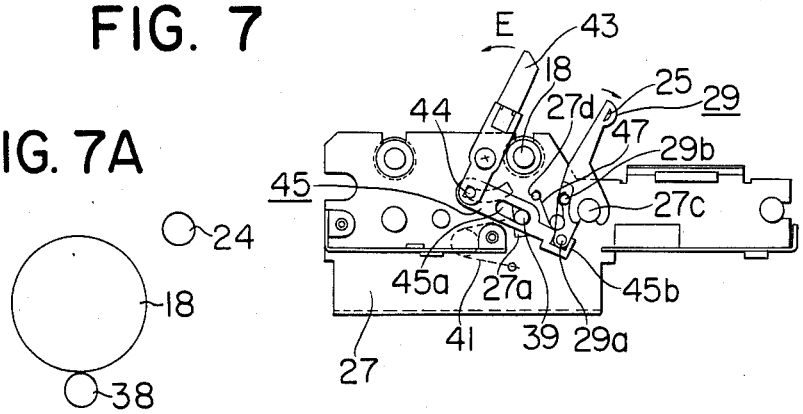
FIG. 8
FIG. 8A
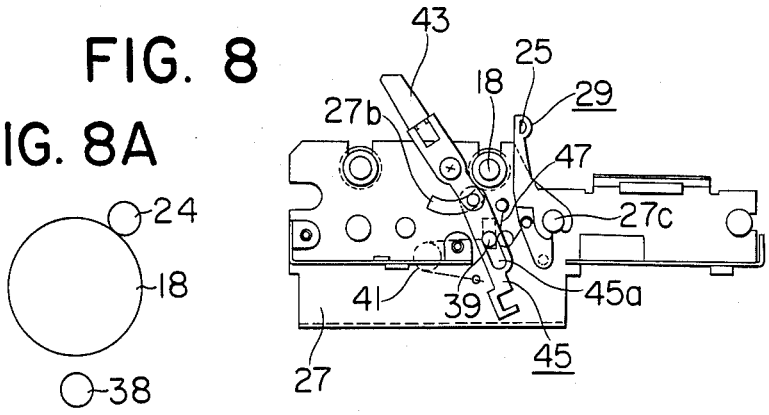
FIG. 9
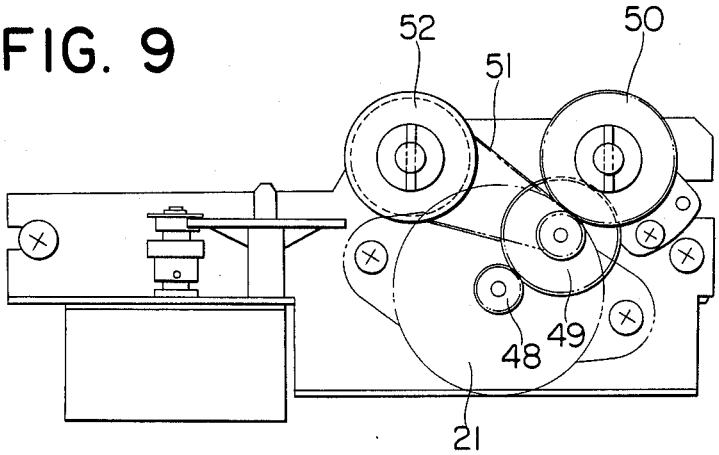

PRINTER

This application is a continuation of application Ser. No. 766,675 filed Aug. 16, 1985, which is a continuation of Ser. No. 558,601, filed Dec. 6, 1983, both now abandoned.

BACKGROUND OF THE INVENTION

1. Field of the Invention

The present invention relates to a printer in which two sets of rollers are maintained in pressure contact with a sheet advancing roller such as a platen roller.

2. Description of the Prior Art

In conventional printers such as a typewriter, two sets of pinch rollers are maintained in contact with a platen roller functioning as a sheet advancing roller. FIGS. 1 and 2 represent a conventional example, in which a printing head 1 mounted on a carriage 2 moves in a direction perpendicular to the plane of the drawing (in FIG. 1) along guide rails 3, 4. In front of the printing head 1 there is provided a platen 5, and a sheet holding roller 6 and a pinch roller 7 are maintained, in separable manner, in contact with the platen 5. A sheet guide 8 introduces a printing sheet 9, introduced from a direction A, between the platen 5 and the pinch roller 7, and the sheet is further guided between the printing head 1 and the platen 5 by rotation thereof in a direction B. The sheet holding roller 6 is at first retracted to position 6' shown in broken line and is brought to position 6 shown in solid line in contact with the platen 5 after the leading end of the printing sheet has passed between the roller 6 and the platen 5. In such a structure, however, at the loading of the printing sheet, the operator is required to perform the cumbersome operation of manually separating the sheet holding roller as shown in FIG. 2 and again bringing the roller in contact with the platen 5 after it is rotated.

This printer can also use a fan-fold printing sheet 10 provided with perforations along both sides. The perforations of such a fan-fold sheet 10 are at first fitted on pins 11*a* of a tractor 11, and the leading end of the sheet is then wound around the platen 5, by moving the sheet holding roller 6 to the position 6', then advancing the fan-fold sheet 10 by means of the platen 5 and the pinch roller 7 and returning the sheet holding roller 6 to position 6 after the leading end of the sheet has passed between the sheet holding roller and the platen, thereby supporting the fan-fold sheet 10 between the roller 6 and the platen 5. Thereafter a lever 12 is actuated to separate the pinch roller 7 from the platen, enabling the printing operation. In this manner the loading of the fan-fold sheet is also quite cumbersome.

SUMMARY OF THE INVENTION

An object of the present invention is to provide a printer allowing easy loading of the printing sheet.

Another object of the present invention is to provide a printer with a simplified structure.

Still another object of the present invention is to provide a printer enabling easy loading of various printing sheets.

Still other objects of the present invention will become fully apparent from the following description.

BRIEF DESCRIPTION OF THE DRAWINGS

FIGS. 6 to 8 are cross-sectional views along line VI—VI in FIG. 4, showing the operation of the printer, and FIGS. 6A to 8A show the positions of other parts of the printer when it is operated as shown in FIGS. 6 to 8, respectively; and FIG. 9 is a lateral view seen from the righthand side in FIG. 4.

DETAILED DESCRIPTION OF THE PREFERRED EMBODIMENTS

Figure 1:
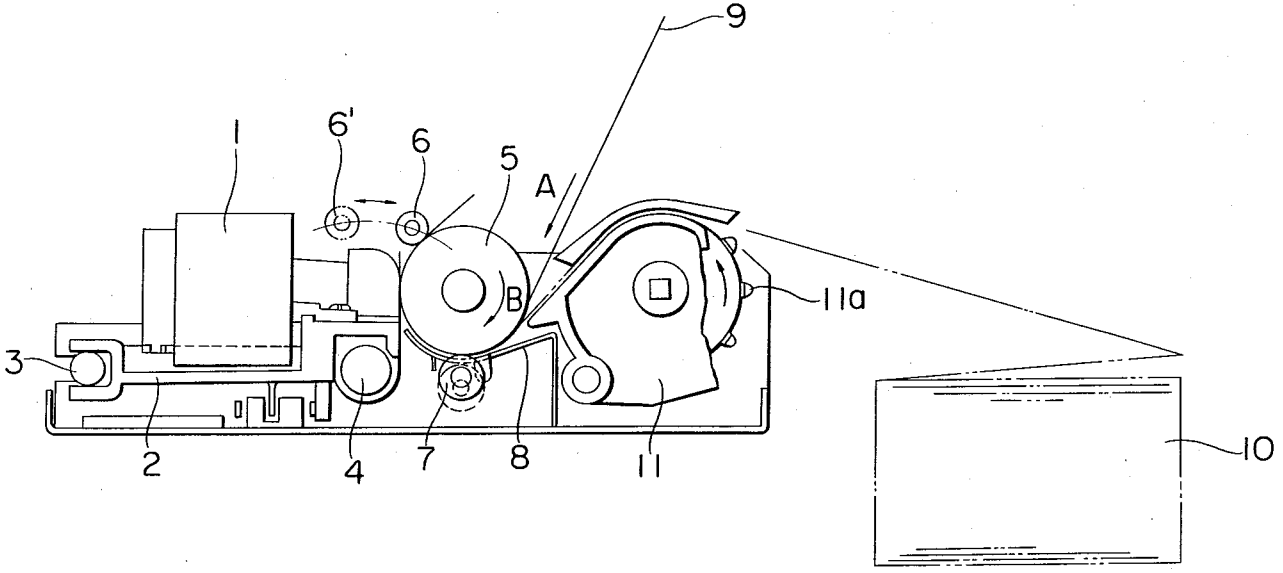
FIG. 1 is a cross-sectional view of a conventional printer.
Figure 2:
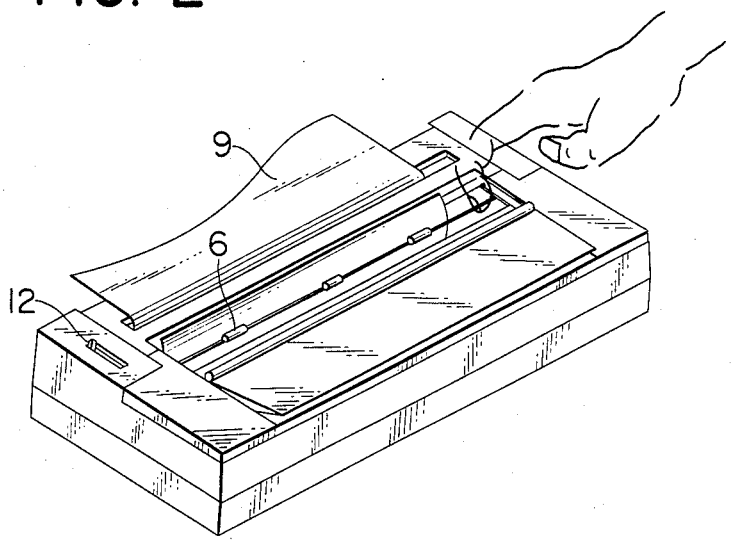
FIG. 2 is a perspective view of a conventional printer.
Figure 3:
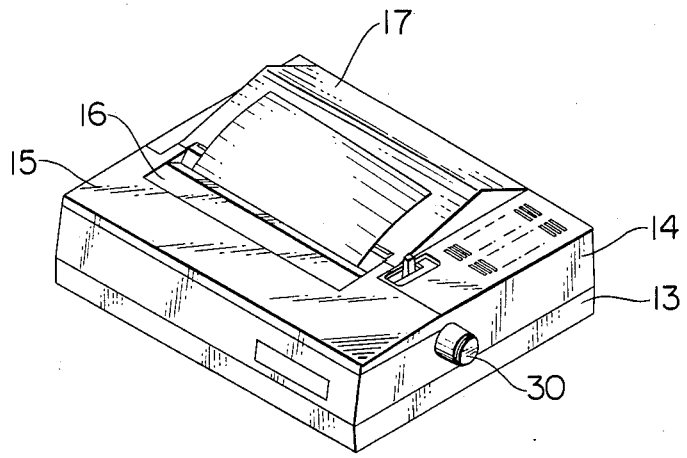
FIG. 3 is an external perspective view of a printer embodying the present invention.
Figure 4:
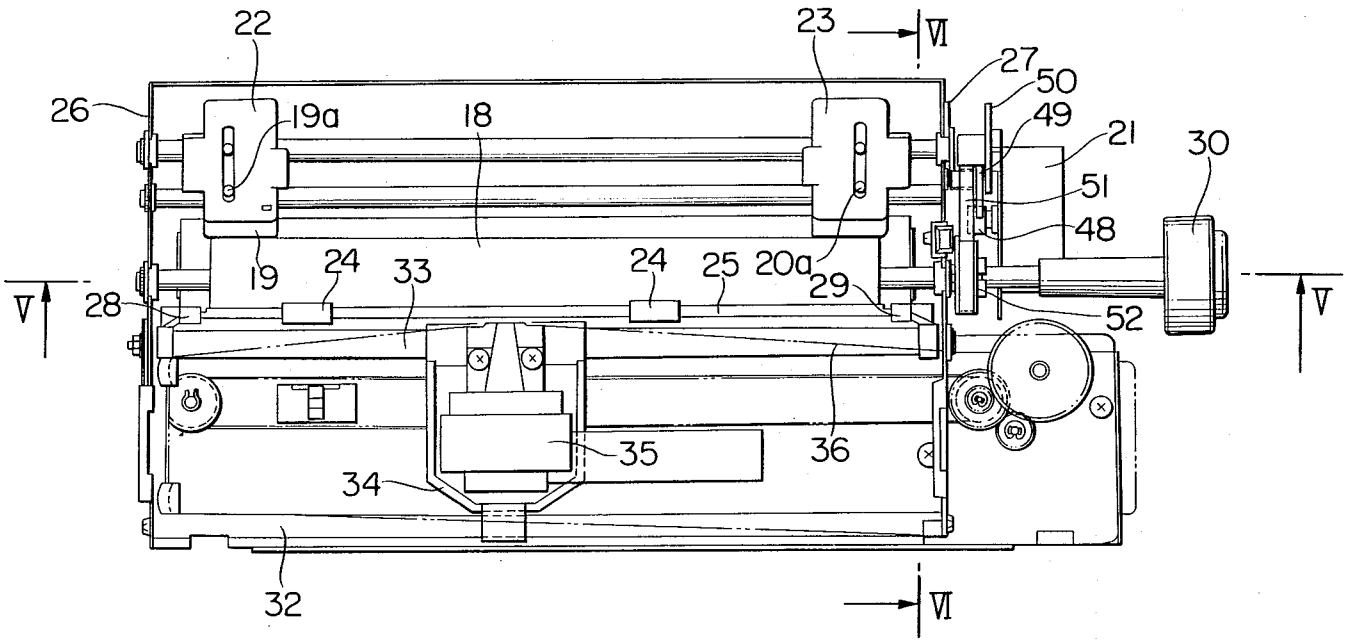
FIG. 4 is a plan view of the printer of FIG. 3.

FIGS. 3 and 4 illustrate a printer embodying the present invention, wherein a lower case 13 and an upper case 14 are held together with screws. A front cover 15 is rotatably supported in the upper case 14 to enable inspection of the interior when opened. A transparent window 16 is integrally mounted on the front cover 15 to enable visual inspection of the obtained print. A rear cover 17 rotatably supported in the upper case 14 covers a platen roller 18, tractors 19, 20, etc., shown in FIG. 4. The tractors 19, 20 are provided with pin wheels with projecting pins 19*a*, 20*a* for engaging with the perforations of a fan-fold sheet, and the pin wheels are rotated by a motor 21 to advance the sheet toward the platen roller 18. As is explained below, the platen roller 18 is linked with the tractors by means of a belt 51 and functions also as a sheet advancing roller for advancing, by rotation thereof, the sheet wound therearound. Tractor covers 22, 23 press the fan-fold sheet against the tractors. Sheet holding rollers 24 are rotatably supported on a shaft 25, which is supported, at the ends thereof, by arms 28, 29 rotatably articulated respectively on printer frames 26, 27. The sheet holding rollers 24 are positioned above a printing head 35 to be explained below and function to maintain the sheet in contact with the platen roller 18 after printing. The contact generates a frictional force between the printing sheet and the platen roller, whereby the printing sheet rotates and advances integrally with the platen roller. Consequently the platen roller 18 and the sheet holding rollers 24 constitute paired means for providing the printing sheet with a force for selectively advancing the sheet. The sheet holding rollers 24, being separably maintained in contact with the platen roller 18, can also be considered as movable pressure rollers for the platen roller 18.

Figure 5:
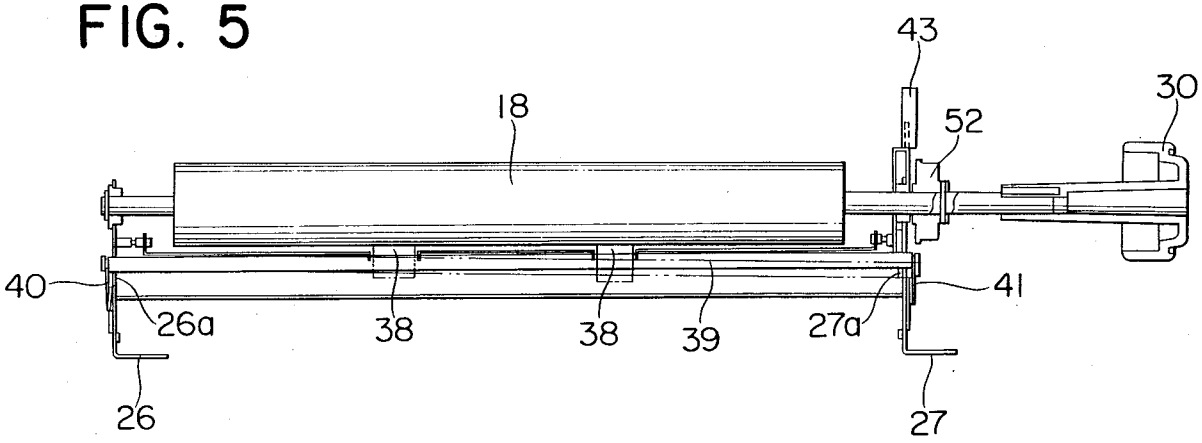
FIG. 5 is a cross-sectional view along line V—V in FIG. 4.
Figure 6:
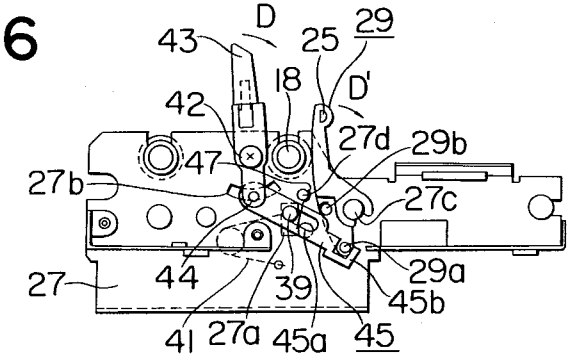
Figure 6A:
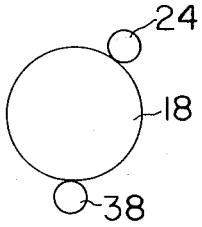

A platen knob 30 is fixed on an end of the shaft 39 of the platen roller 18. In front of the platen roller 18 a carriage 34 is guided by guide rails 32, 33 along the shaft of the platen roller and is equipped thereon with a printing head 35, for example a wire dot-matrix head, for striking an unrepresented printing sheet on the platen roller 18 through an ink ribbon 36 to obtain an impression on the sheet. As shown in FIG. 5, pinch rollers 38 are maintained in contact with the platen roller 18. The pinch rollers 38 are rotatably supported on shaft 39, which is fitted, at the ends thereof, in guide grooves 26*a*, 27*a* respectively provided in the frames 26, 27 and is constantly biased toward the platen roller by means of torsion springs 40, 41 constituting biasing means, whereby the pinch rollers 38 may be separated from or be brought into contact with the platen roller 18 by means of a lever 43 which is articulated, as shown in FIG. 6, on the frame 27 at a point 42.

In this manner the pinch roller 38 can be separated from or be brought into contact with the platen roller 18 at positions below the printing head 35, thus maintaining the printing sheet before printing in contact with the platen roller. The contact generates a frictional force between the printing sheet and the platen roller 18, whereby the printing sheet rotates and advances integrally with the platen roller. Consequently the platen roller 18 and the pinch rollers 38 constitute paired means for providing the printing sheet with a force for selectively advancing the sheet. Also the pinch rollers 38 may be considered as movable pressure rollers similar to the aforementioned sheet holding rollers 24.

A manipulating lever 43 controls a mechanism for moving the sheet holding rollers 24 and the pinch rollers 38 away from or in contact with the platen roller 18. The mechanism is explained in more detail in the following.

The manipulating lever 43 is provided at an end thereof with a projection 44, which is rotatably fitted with an end of a link lever 45 and is further fitted in an arc-shaped guide groove **27*b* provided in the frame 27. The link lever 45 is provided, at the center thereof, with a longitudinally oblong hole 45*a* in which is fitted an end of the shaft 39 of the pinch rollers 38. The other end of the link lever 45 is formed as a hook 45*b***.

The link lever 45 transmits the movement of the manipulating lever 43 to the arm 29 for contacting or separating the sheet holding rollers 24 with or from the platen roller 18, and is also adapted, as is explained below, to be disconnected from the arm 29 thereby contacting or separating the pinch rollers 38 alone with or from the platen roller 18 in response to the movement of the manipulating lever 45.

Also as is explained below, the link lever 45 cooperates with the torsion springs 40, 41 to maintain elastically, the pinch rollers 38 either in the contact position or in the separated position. The arm 29 is rotatably supported on a shaft **27*c* projecting from the frame 27, and the arm 28 is likewise rotatably supported by the frame although it is not illustrated. The arm 29 supports, at an end thereof, an end of the shaft 25 for the sheet holding rollers 24, and is provided at the other end with a projection 29*a* engaging the hook 45*b* of the link lever 45. A torsion spring 47, constituting biasing means, is provided between a projection 29*b* of the lever 29 and a projection 27*d* of the frame 27, whereby the lever 29 is elastically maintained, selectively in a position maintaining the sheet holding rollers 24 in contact with the platen roller 18 as shown in FIG. 6 or a position separating the sheet holding rollers 24 from the platen roller as shown in FIG. 7. Although not illustrated, another torsion spring is provided between the frame 26 and the arm 28 for maintaining the same in either of two positions. FIG. 9 shows a lateral view seen from the right-hand side of FIG. 4, wherein a driving gear 48 fixed on the shaft of the motor 21 engages, through an intermediate gear 49, with a gear 50 for driving the tractors 19, 20. The intermediate gear 49 is linked, through the belt 51, with a pulley 52 fixed at an end of the platen roller 18, and the sheet slack can be prevented if the quantity of sheet advancement by the platen roller 18 is selected somewhat larger than that by the tractors 19, 20**.

In the following is given an explanation of the method of use of the above-described embodiment.

First is explained the procedure of loading a printing sheet without perforations, such as a cut sheet or a rolled sheet. The manipulating lever 43 shown in FIG. 6 is shifted in a direction D whereby the link lever 45 moves, guided by the shaft 39 supporting the pinch rollers. Simultaneously the levers 28, 29 move in a direction D′ since the hook **45*b* formed at an end of the link lever 45 engages with the projection 29*a* formed on the lever 20. With the movement of the levers 28, 29 the torsion spring 47 moves and passes the dead point, whereby the levers 28, 29 are maintained in a position of separating the sheet holding rollers 24 from the platen roller 18 as shown in FIG. 7. In this state the printing sheet is inserted between the platen roller 18 and the unrepresented sheet guide and reaches a position between the platen roller 18 and the pinch rollers 38. By manual rotation of the platen knob 30, the printing sheet advances and emerges between the sheet holding rollers 24 and the platen roller 18. Then the manipulating lever 43 is returned to the position shown in FIG. 6 whereby the levers 28, 29 are reversed in a procedure inverse to what was explained above and are biased by the torsion spring 47 whereby the sheet holding rollers 24 maintain the printing sheet in contact with the platen roller 18. Then, in response to a control signal from an unrepresented control circuit, the power of the motor 21 is transmitted through the gear 48, intermediate gear 49 and belt 51 to the pulley 52 for advancing the sheet, and the printing head 35** is driven in the lateral directions for effecting desired printing.

In the following is explained the operation of the above-described device in the case of using a fan-fold sheet having perforations on both sides.

A first the manipulating lever 43 shown in FIG. 6 is shifted in the direction D, whereby the levers 28, 29 are shifted in the direction D′ in linkage with the link lever 45 as explained above, thus maintaining the sheet holding rollers 24 at a position separate from the platen roller 18.

Then the perforations of the fan-fold sheet are fitted with the pins **19*a*, 20*a* of the tractors 19, 20 and the tractor covers 22, 23 are closed. The platen knob 30 is then manually rotated, and the rotation is transmitted, through the pulley 52, but 51 and intermediate gear 49, to the gear 50 to rotate the pins 19*a*, 20*a* whereby the fan-fold sheet is guided between the platen roller 18 and the pinch rollers 38, and then between the platen roller 18 and the sheet holding rollers 24. Subsequently the manipulating lever 43 is shifted in a direction E as shown in FIG. 7 whereby the oblong hole 45*a* formed in the link lever 45 presses down an end of the shaft 39 for the pinch rollers against the force of the torsion spring 41, thus shifting and, because the shaft 39 passes the dead point relative to the guide groove 27*b*, maintaining the pinch rollers 38 and the shaft 39 at a position represented by double-dotted chain line shown in FIG. 5**.

This state is shown in FIG. 8, in which the pinch rollers 38 are separated from the platen roller 18 but the sheet holding rollers 24 are maintained in contact with the platen roller 18 across the fan-fold sheet. Consequently the fan-fold sheet is advanced by a force generated by the tractors 19, 20 and by a force generated by the platen roller 18 and the sheet holding rollers 24, and is constantly given a suitable tension enabling satisfactory sheet advancement.

FIGS. 6A to 8A illustrate schematically the positions of the sheet holding rollers 24 and the pinch rollers 38 relative to the platen roller 18 when the manipulating lever 43 is moved to the positions shown in FIGS. 6 to 8, respectively.

What I claim is:

1. A printer comprising:

a sheet advancing roller having wound around it a first printing sheet with perforations or a second printing sheet without perforations and adapted, upon rotation, for advancing the printing sheet of either type;

advancing means, provided with a plurality of pins around the periphery thereof, for advancing the first printing sheet to said sheet advancing roller upon rotation when the perforations of the first printing sheet are fitted on the pins, said advancing means effecting sheet advancing upon rotation of said sheet advancing roller;

holding means for holding said printing sheet to said advancing means so as to maintain the perforations of the first printing sheet on the pins of said advancing means;

means for manually rotating said sheet advancing roller;

first and second movable pressure rollers which can be maintained in contact with or separated from said sheet advancing roller, said first movable pressure roller being located nearer said advancing means than said second movable pressure roller; and operating lever means comprising a movable lever and a link attached to said lever for contacting or separating said first and second movable pressure rollers with or from said sheet advancing roller, said link having first and second opposite ends, the first end of said link being pivotally connected to said lever, the second end of said link being formed with a hook, said first movable pressure roller having an axle which engages a slot in a central portion of said link, said movable lever having a first position wherein said first and second movable pressure rollers are in contact with said sheet advancing roller, a second position wherein said first movable pressure roller is in contact with said sheet advancing roller and said second movable pressure roller is separated from said sheet advancing roller by said link and a third position wherein said first movable pressure roller is separated from said sheet advancing roller by said link and said second movable pressure roller is in contact with said sheet advancing roller, in said second position the hook of said link engaging a projection on an arm mounting said second movable pressure roller so as to cause said arm to pivot, thus releasing the second movable pressure roller from said sheet advancing roller, in said third position said link causing the axle of the first movable pressure roller translate, thus causing the first movable pressure roller to be released from said sheet advancing roller, also in the third position said hook becoming disengaged from the projection of the arm allowing the second movable pressure roller to remain engaged with the sheet advancing roller, said movable lever being maintained in a positive detent location in said first position, said second position and said third position.

2. A printer according to claim 1, wherein said sheet advancing roller comprises a platen roller, wherein said first and second movable pressure rollers are positioned on both sides of a recording head positioned to face said platen roller.

3. A printer according to claim 1, wherein said operating lever means for contacting or separating further comprises a first biasing member for maintaining elastically said first movable pressure roller at either of a position contacting said sheet advancing roller and another position separate therefrom, and a second biasing member for maintaining elastically said second movable pressure roller at either of a position contacting said sheet advancing roller and another position separate therefrom.

4. A printer comprising:

a sheet advancing roller having wound around it a printing sheet with perforations and adapted, upon rotation, for advancing the printing sheet;

advancing means, provided with a plurality of pins around the periphery thereof, for advancing the printing sheet to said sheet advancing roller upon rotation when the perforations of the printing sheet are fitted on the pins, said advancing means effecting sheet advancing upon rotation of said sheet advancing roller;

holding means for holding said printing sheet to said advancing means so as to maintain the perforations of the printing sheet on the pins of said advancing means;

means for manually rotating said sheet advancing roller;

first and second movable pressure rollers which can be maintained in contact with or separated from said sheet advancing roller, said first movable pressure roller being located nearer said advancing means than said second movable pressure roller; and operating lever means comprising a movable lever and a link attached to said lever for contacting or separating said first and second movable pressure rollers with or from said sheet advancing roller, said link having first and second opposite ends, the first end of said link being pivotally connected to said lever, the second end of said link being formed with a hook, said first movable pressure roller having an axle which engages a slot in a central portion of said link, said movable lever having a first position wherein said first and second movable pressure rollers are in contact with said sheet advancing roller, a second position wherein said first movable pressure roller is in contact with said sheet advancing roller and said second movable pressure roller is separated from said sheet advancing roller by said link and a third position wherein said first movable pressure roller is separated from said sheet advancing roller by said link and said second movable pressure roller is in contact with said sheet advancing roller, in said second position the hook of said link engaging a projection on an arm mounting said second movable pressure roller so as to cause said arm to pivot, thus releasing the second movable pressure roller from said sheet advancing roller, in said third position said link causing the axle of the first movable pressure roller translate, thus causing the first movable pressure roller to be released from said sheet advancing roller, also in the third position said hook becoming disengaged from the projection of the arm allowing the second movable pressure roller to remain engaged with the sheet advancing roller, said movable lever being maintained in a positive detent location in said first position and said second position.

* * * * *

UNITED STATES PATENT AND TRADEMARK OFFICE

CERTIFICATE OF CORRECTION

PATENT NO. : 4,717,274

DATED : January 5, 1988

INVENTOR(S) : TETSUO KIMURA

It is certified that error appears in the above-identified patent and that said Letters Patent is hereby corrected as shown below:

COLUMN 3

Line 3, "pinch roller 38" should read --pinch rollers 38--.

Line 19, "in" should read --into--.

Line 53, "or a" should read --or in a--.

COLUMN 4

Line 9, "lever 20." should read --lever 29.--.

Line 44, "but 51" should read --belt 51--.

COLUMN 5

Line 56, "translate," should read --to translate,--.

COLUMN 6

Line 59, "translate," should read --to translate,--.

Signed and Sealed this

Ninth Day of August, 1988

*Attest:*

*Attesting Officer*

DONALD J. QUIGG

*Commissioner of Patents and Trademarks*